US007370916B2

(12) United States Patent
Ley et al.

(10) Patent No.: US 7,370,916 B2
(45) Date of Patent: May 13, 2008

(54) REAR LOADER ROAD MILLING MACHINE WITH HEIGHT-ADJUSTABLE SEALING DEVICE

(75) Inventors: Herbert Ley, St. Katharinen (DE); Olaf Gaertner, Linz/Rhein (DE); Stefan Abresch, Dierdorf (DE); Dieter Simons, Buchholz (DE)

(73) Assignee: Wirtgen GmbH, Windhagen (DE)

( * ) Notice: Subject to any disclaimer, the term of this patent is extended or adjusted under 35 U.S.C. 154(b) by 75 days.

(21) Appl. No.: 10/961,105

(22) Filed: Oct. 8, 2004

(65) Prior Publication Data

US 2005/0123350 A1 Jun. 9, 2005

(30) Foreign Application Priority Data

Oct. 10, 2003 (DE) ..... 103 47 874

(51) Int. Cl.
*E01C 23/12* (2006.01)

(52) U.S. Cl. ..... 299/39.2; 404/90

(58) Field of Classification Search ..... 299/18, 299/36.1, 39.1, 39.2, 39.4, 39.6; 404/90–94
See application file for complete search history.

(56) References Cited

U.S. PATENT DOCUMENTS 4,041,623 A * 8/1977 Miller et al. ..... 37/382
4,186,968 A * 2/1980 Barton ..... 299/39.2
4,619,412 A * 10/1986 Willingham ..... 241/101.762
4,723,867 A * 2/1988 Wirtgen ..... 404/90
5,190,398 A * 3/1993 Swisher, Jr. ..... 404/90
5,354,147 A * 10/1994 Swisher, Jr. ..... 299/39.6
5,893,677 A * 4/1999 Haehn et al. ..... 404/90
2004/0075330 A1* 4/2004 Holl et al. ..... 299/39.2

FOREIGN PATENT DOCUMENTS

DE 35 28 038 2/1987

OTHER PUBLICATIONS

European Search Report dated Oct. 7, 2005, in corresponding EP application No. 04022744.9.

* cited by examiner

*Primary Examiner*—Sunil Singh
(74) *Attorney, Agent, or Firm*—Marshall, Gerstein & Borun LLP

(57) ABSTRACT

A rear-loader road milling machine with a milling roll, which is arranged in a roller housing open on the bottom, and having an opening between a front part of the roller housing and a road surface, that faces in a direction of travel, which can be closed with a sealing device, the height of which can be altered. The sealing device can be pivoted around an axis in front of the milling roll for the purpose of adjusting the height of the sealing device. As a result of the pivotability of the sealing device on an axis, it becomes possible to pull the sealing device slidingly above the road surface so that it follows any unevennesses, for example, waviness of the road surface or existing milling tracks, following these unevennesses by pivoting frontward and backwards. Interruption or even blocking of the advance by jamming is excluded in this way. The sealing device also provides safe protection against milled material thrown forward.

19 Claims, 4 Drawing Sheets

REAR LOADER ROAD MILLING MACHINE WITH HEIGHT-ADJUSTABLE SEALING DEVICE

BACKGROUND OF THE DISCLOSURE

1. Field of the Disclosure

The disclosure concerns a rear loader road milling machine with a milling roll.

2. Related Technology

In the field of road construction, especially in preparation and maintenance of surfaces with traffic on them, road milling machines are generally used for producing traffic area surfaces.

Typical road milling machines include a chassis supported on wheels or on chain mechanisms. Furthermore, a milling roll is provided in the chassis, which is arranged in a roller housing, which is open on the bottom, i.e., in the direction of the road surface. In order to transport away the material removed by milling (referred to herein as "milled material"), road milling machines typically have a transport device through which the milled material can be introduced into an accompanying truck with a corresponding loading area. In so-called "rear loaders," the milled material is introduced into the truck through the rear of the road milling machine; in the case of a "front loader," the milled material is transported through the front of the road milling machine to the truck.

In order to work the road paving, road milling machines are typically sunk below the road paving, so that the rotating milling roll protruding from the roller housing comes in contact with the road paving; sinking is usually done through lifting the wheels on which the chassis of the road milling machine is supported.

When the rate of rotation of the milling roll is relatively high, the milled material is highly accelerated. This presents problems, especially from the point of view of work safety, since the working personnel could be injured by the milled material thrown out. Moreover, it is possible that the milled material is thrown under the wheels that carry the chassis, resulting in damage to the wheels and changes in the milling depth and the milling pattern. When the milled material arrives outside the milling track, it is no longer collected by the stripping device. Then the milled material must be collected with a sweeper, which requires an additional step in the process. In order to overcome these disadvantages, different attempts were made in the past to prevent the throwing out of milled material.

In order to prevent throwing out of the milled material through the side, road milling machines may have a roller housing of which has side plates on both sides, the height of which can be adjusted, this is called "edge protection." This system proves to be useful, since throwing out the milled material on the side is of only lesser importance due to the direction of rotation of the milling roll.

In order to prevent the milled material from being thrown out toward the rear, that is, against the direction of travel, stripping devices have been used. These include a plate-shaped stripper arranged behind the milling roll, the essential task of which consists in stripping the milled material remaining on the milled surface so that it can be introduced into a transport device and will not remain on the processed surface.

The area in front of the milling roll in the direction of travel is problematic. Here, especially at low milling depths, a large opening is present between the front part of the roller housing and the road surface, through which the milled material can be thrown out toward the front and also to the sides.

DE 197 39 915 C2 describes a raised verge milling aggregate in which a splashboard and baffle plate are rigidly arranged in front of the milling roll in the direction of travel, so that the majority of the milled material thrown out toward the front is collected or is diverted in the direction of the rear of the known aggregate. However, the known aggregate has the disadvantage that the milling depth is limited due to the rigid arrangement of the splashboard and baffle plate. Moreover, an opening facing in the direction of travel remains between the lower edge of the splashboard and baffle plate and the subsurface through which milled material can be thrown toward the front and also to the sides.

In order to solve the problems described above, rubber skirts which extend downwardly starting from the front part of the roller housing have been developed. Such rubber skirts are flexible so that they can be deform depending on lowering of the road milling machine and thus on the milling depth. Such rubber skirts should lie against the road surface during the milling process, independently of the milling depth, so that there is no opening between the front part of the roller housing and the road surface. However, a disadvantage is that such skirts in practice do not provide sufficient sealing against the thrown out milled material, especially at low milling depths. Thus, the skirts tend to deform in a wavy pattern so that tight contact is not provided. Also, the skirts are subject to great wear.

Since rubber skirts provide insufficient sealing, shield arrangements were developed in which a rigid, mostly metallic shield can be guided in vertical guides, perpendicularly to the road surface to be processed, in front of the opening between the front part of the roller housing and the road surface. Thus, the known shields can be adjusted in height, depending on the milling depth, where the adjustment is done through insertable bolts or by suspension on a chain. Although the shields used show a greater stability against the milled material whirling in front of them, especially at low milling depths, a distance between the shield and the road surface always remains, even though it is smaller, so that still parts of the milled material can be thrown out toward the front and also the sides. This is to be attributed to the fact that the known shields must not lie directly on the road surface since, in the case of unevennesses of the road surface, for example, in the case of waviness of the road surface or when crossing of already existing milling tracks, this can lead to hindering of the advance, if not to complete blocking of the advance, which is to be attributed to jamming of the shield in the road surface.

SUMMARY

The disclosure provides a rear loader road milling machine with a sealing device for an opening toward the direction of travel, between the front part of the roller housing and the road surface, which provides reliable protection against milled material thrown out toward the front, while maintaining the predetermined advance of the milling roll.

BRIEF DESCRIPTION OF THE DRAWINGS

The disclosure will be explained in more detail below with the aid of practical examples with reference to the attached drawing figures.

DETAILED DESCRIPTION

Figure 1:
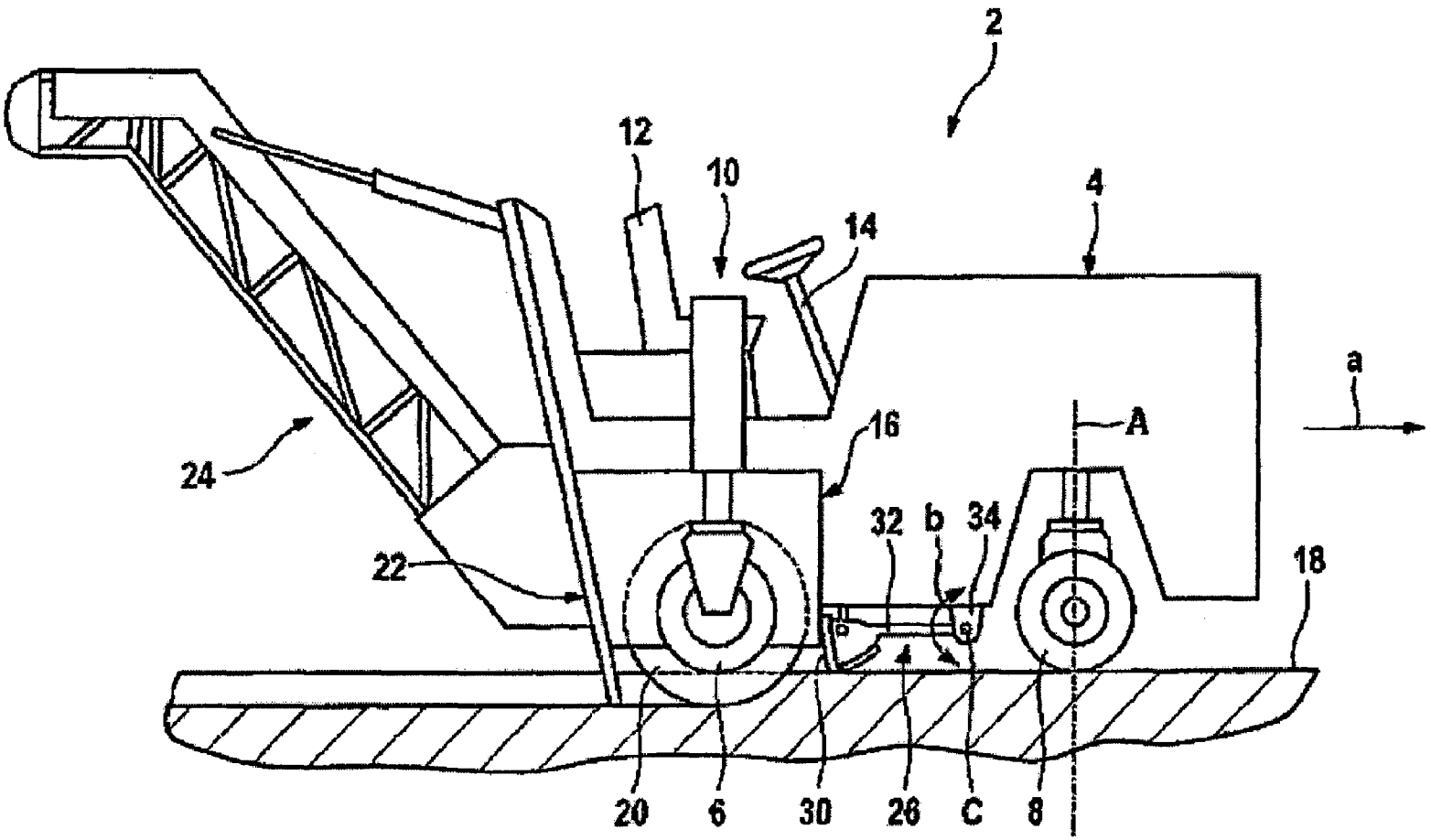
FIG. 1 is a schematic representation of an embodiment of the rear loader road milling machine in side view.

The road milling of the disclosure is designed as a so-called rear loader, i.e., the milled material is removed through the back of the road milling machine through a corresponding transport device. The road milling machine has a milling roll, which is arranged in a rotor housing open toward the bottom. An opening in the direction of travel between a front part of the roller housing and the road surface can be closed with a sealing device. The height of the sealing device can be adjusted. The sealing device can be tilted along an axis in the direction of travel in front of the milling roll in order to adjust the height.

The sealing device is tiltable along an axis which is arranged in the direction of travel in front of the milling roll, and it is thus possible to swivel the sealing device all the way to the road surface, so that there is no gap between the front part of the roller housing and the road surface, through which milled material could be thrown out toward the front. Moreover, in contrast to the known vertically movable baffle plates, the disclosed sealing device cannot jam with the road surface. Rather, the sealing device is pulled so that it slides over the road surface due to the special suspension used, so that, if there is unevenness, for example, waviness of the road surface, or if there are existing milling tracks, the unevenness is followed by tilting backward and forward. Interruption or even blocking of the advance by jamming is therefore prevented. The disclosed sealing device has advantages even in comparison to rubber skirts, since the pressing pressure on the road surface by the sealing device is not dependent on the milling depth, as is the case with the deformable rubber skirt. Rather, with the sealing device of the disclosed road milling machine, a constant pressing pressure can be applied on the road surface, which is independent of the milling depth, so that throwing out of milling material is prevented, even at low milling depths.

In an advantageous embodiment of the disclosed road milling machine, the sealing device has a baffle plate which faces the opening. Such a baffle plate can be made, for example, of metal, as can the roller housing.

In an especially preferred embodiment, the sealing device has a swivel arm. On the one hand, the swivel arm is secured on the baffle plate and, on the other hand, it extends to the axis around which the sealing device can be pivoted. Instead of one swivel arm, naturally two or more swivel arms can be provided. Thus, for example, an arrangement may be expedient in which two swivel arms are provided, one end of which extends to the side ends of the baffle plate and the other end of which is guided rotatably to the ends of the axis.

In another advantageous embodiment, the baffle plate has a circular-arc-shaped cross-section. Here it is especially preferred that the radius of the circular-arc-shaped cross-section corresponds to the distance between the axis and the baffle plate. In this way, the baffle plate is always at the same distance to the axis. Thus, the baffle plate can always be in front-side contact with the front part of the roller housing, independently of the pivot position without additional aids being necessary which would have to compensate for an altered distance between the roller housing and baffle plate.

In an especially preferred embodiment, the sealing device can be pivoted around the axis with constant formation of a contact line with the front part of the roller housing.

In order to increase tightness in the region of the contact line or to prevent wear at the neighboring parts, in an especially preferred embodiment, a longitudinally extending sealing or stripping element is provided on the roller housing along the contact line. For example, this can be a rubber band where the sealing or stripping element should advantageously be replaceable in order to be able to exchange worn elements for new ones.

In another advantageous embodiment, the sealing device has at least one undercarriage skid which faces the road surface. One or several undercarriage skids makes simpler sliding of the sealing device over the road surface. It is especially advantageous when the undercarriage skid or skids extend in the direction of travel of the road milling machine.

In order to be able to detect all unevennesses on the road surface with the undercarriage skid, in another preferred embodiment of the invention, the undercarriage skid extends over the entire width of the sealing device.

In another advantageous embodiment, the undercarriage skid is bowed downward. In this way, it is ensured that the undercarriage skid rolls on the road surface over its entire length when it is swiveled and does not lie suddenly on its ends, as would be the case with a straight undercarriage skid. Thus, uniform wear of the undercarriage skid is ensured, which leads to an increased life of the undercarriage skid.

In another advantageous embodiment, the sealing device can be swiveled against the road surface with the formation of a contact line with the road surface.

In order to keep wear of the sealing device low, in another preferred embodiment, a sliding strip is provided along the contact line of the sealing device with the road surface.

In another embodiment, the undercarriage skid and/or the sliding strip can be replaced in order to be able to change worn undercarriage skids or sliding strips to new undercarriage skids or sliding strips.

Preferably, the undercarriage skid and/or sliding strip is made of a hardened material, which has a greater hardness than the material of the remaining components of the sealing device, so that the undercarriage skid or sliding strip in contact with the road surface is subject to low wear.

In a specially preferred embodiment, the sealing device can be swiveled against the road surface with a predetermined pressure. This has the advantage that the sealing device will not be swiveled upward at every little hindrance, for example, by parts of milling material remaining on the road surface. Rather, the softer hindrances are compressed or squeezed together by the applied pressure. The pressure itself can be provided, for example, by a spring element which acts on the sealing device or simply can be originating from the weight of the sealing device itself.

In addition to the above embodiment, the sealing device in a further embodiment can be swiveled back when a predetermined pressure is exceeded. Thus, the sealing device follows harder or larger unevennesses and hindrances but without lifting up from the road surface.

It is especially preferred to be able to swivel the sealing device with a hydraulic device around the axis. In an especially advantageous embodiment of the disclosed road milling machine, a constant hydraulic pressure can be set where the hydraulic device makes it possible for the sealing device to pivot back when the predetermined pressure is exceeded. This can be done, for example, with the aid of a pressure limit valve within the hydraulic device.

Advantageously, the sealing device can be locked in different swiveled positions. Thus, the sealing device can be, for example, swiveled back and locked in a transport position, in which the sealing device does not lie on the road surface. The locking can be done with conventional means, for example, a catenary suspension system or by inserting bolts. Preferably, the locking can also be done with the hydraulic device.

FIG. 1 shows the schematic representation of an embodiment of a rear loader road milling machine, generally designated 2. The road milling machine 2 has a chassis 4 which, in the present embodiment, is supported on three wheels 6, 6, 8, where the two rear wheels 6, 6 (only one can be seen in FIG. 1) are arranged in the region of the rear, and the front wheel 8 is arranged in the middle, in the region of the front side of the road milling machine 2. The height of the rear wheels 6, 6 can be adjusted, while the steering of the road milling machine 2 is done via a front wheel 8, which can rotate around a vertical axis A. Alternatively, such a road milling machine 2 can also run on a chain mechanism instead of the wheels 6,6,8. The number of wheels or chain mechanisms provided can also vary.

Furthermore, within the chassis, there is at least one drive device for a milling roll, for its wheels 6,6,8 and the hydraulic device, as well as the additional aggregates known in the state of the art, but these are not represented here for the sake of clarity.

A driver stand 10 is provided up in the rear of the road milling machine 2 where, among others, there is a seat 12 for the operating personnel and a steering device 14 for steering the front wheel 8.

A roller housing 16 is located below the driver stand 10, so that this is also in the region of the rear of the road milling machine 2. The roller housing 16 is a housing, which is open on the bottom, that is, in the direction of a road surface 18, and a milling roll 20 is arranged in it, whereby the longitudinal axis of the milling roll 20 extends transversely to the direction of travel, as it is shown in FIG. 1 with the aid of an arrow a. The milling roll 20 protrudes from the roller housing 16 downwardly in the direction of the road surface 18.

The road milling machine 2 can be equipped, for example, with a fast milling roll exchange system, with which replacement of the milling roll 20 by a milling roll with smaller or larger milling width or by a milling roll with a different construction, is possible with low time and mounting expenditure.

A stripping device 22, of adjustable height, is provided at the rear end, in the direction of travel a, of the roller housing 16. Looking in the direction of travel a, behind the stripping device 22, again in the direction of travel a, a transport device 24 is provided, through which the milled material can be introduced into an accompanying truck with the corresponding loading area (not shown). Since the milled material is introduced to the truck through the rear of the road milling machine, the machine 2 is a so-called rear-loader road milling machine.

Figure 2:
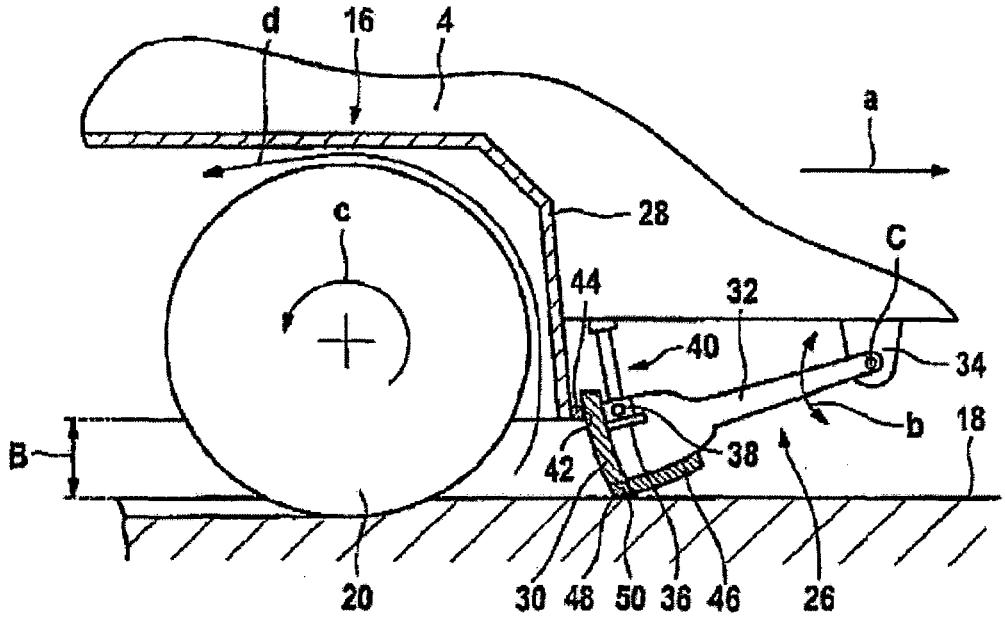
FIG. 2 is a section of FIG. 1 in a partially cut representation, where the position of the sealing device is shown at low milling depth.
Figure 3:
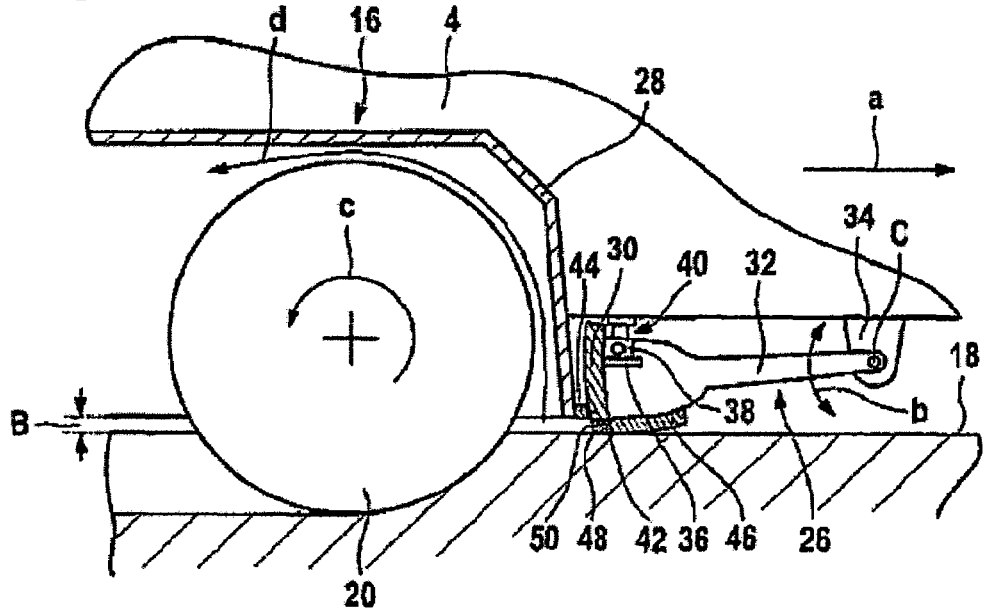
FIG. 3 is a section of FIG. 1 in a partially cut representation, where the position of the sealing device is shown at larger milling depth.

A sealing device 26 is provided in the direction of travel a in front of the milling roll 20, which will be explained in more detail with reference to FIGS. 2 to 4.

The roller housing 16 has a front part 28 in the direction of travel a, which is usually made of a continuous plate. Since this front part 28 must not come into contact with the road surface 18, which would unavoidably lead to damage of the front part 28 or to hindrance of advance in the direction of travel a, an opening B, directed toward the front, always remains between the front part 28 and the road surface 18. This opening B is closed by the sealing device 26.

The sealing device 26 is designed so that its height can be adjusted, whereby it can be swiveled around an axis C, for the purpose of adjusting the height, which axis is arranged in the direction of travel a in front of the milling roll 20, as it is indicated with the aid of an arrow b.

In the embodiment shown, the sealing device 26 has a baffle plate 30 facing the opening B, extending over the entire width of the roller housing 16 and thus over the entire width of the milling roll 20. Furthermore, the sealing device 26 has a swivel arm 32 which is secured on the side of the baffle plate 30 which faces the opening B and extends toward the front up to the axis C in the direction of travel a, and where the swivel arm 32 can be pivoted around the axis C, being supported in a suspension 34 which, in turn, is arranged on the chassis 4.

Furthermore, the sealing device 26 has a reinforcing rib 36 which extends transversely on the side of baffle plate 30 which faces away from the opening B. Furthermore, on this reinforcing rib, means 38 are provided for connecting the sealing device 26 with a piston/cylinder arrangement 40 of the hydraulic device, which is not shown here and which serves for lifting and lowering the sealing device 26.

Figure 4:
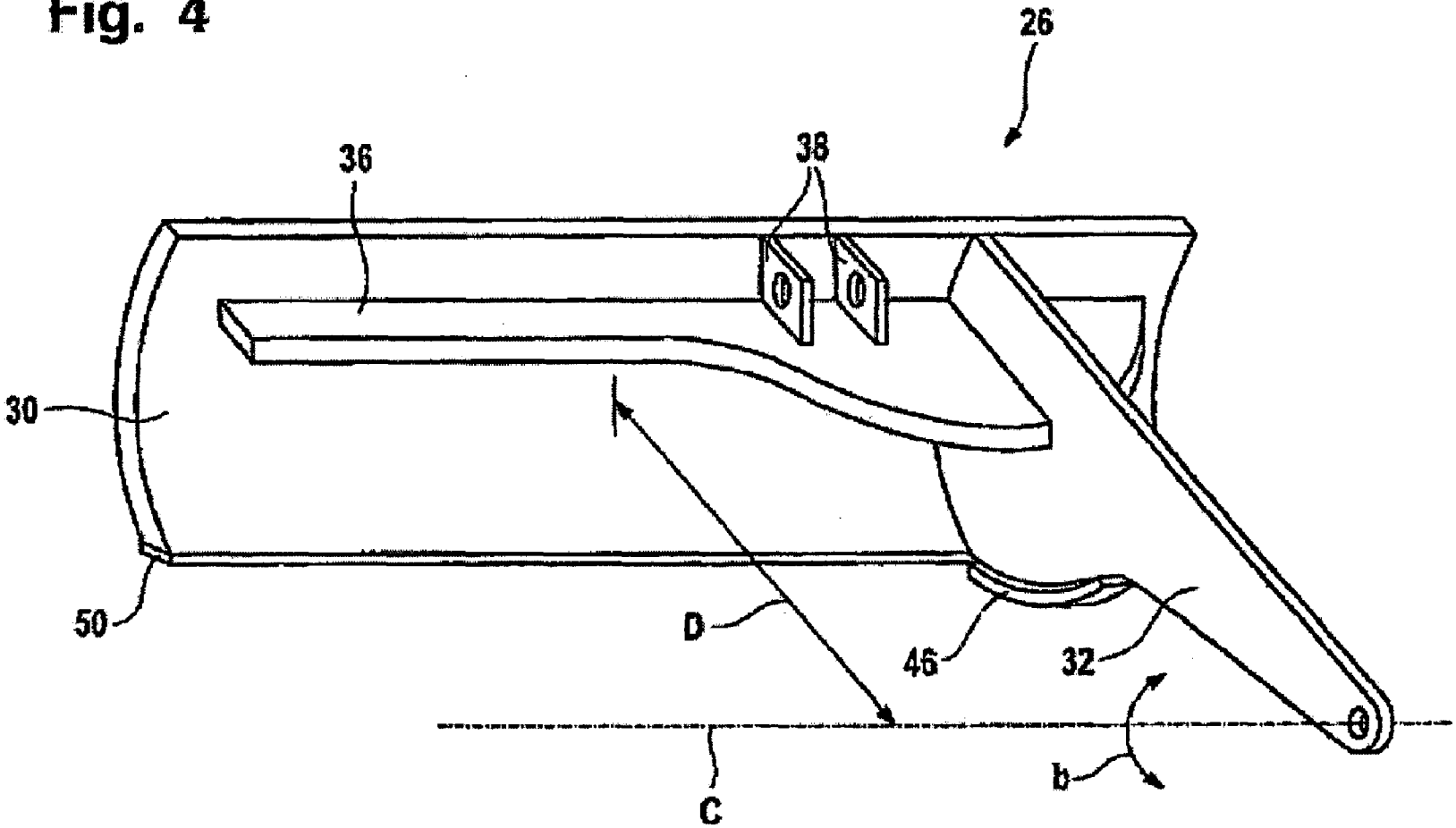
FIG. 4 is a perspective view of the sealing device of FIGS. 1 to 3.

Furthermore, the baffle plate 30 has a circular-arc-shaped cross-section, where the radius of the circular-arc-shaped cross-section corresponds to the distance D between the axis C and the baffle plate 30 (see FIG. 4).

When pivoting the sealing device 26 around the axis C, the sealing device 26 and its baffle plate 30 permanently form a contact line 42 with the front part 28 of the roller housing 16, so that there is no exit for any milled material that was thrown forward. "Permanent" in this connection is to be understood to mean that the contact line 42 remains independent of the swiveling position of sealing device 26. In order to provide especially high tightness, a longitudinally extending sealing or stripping element 44 is provided on the roller housing 16 or on its front part 28 along the contact line 42, and this element is applied advantageously so that it is replaceable.

Figure 5:
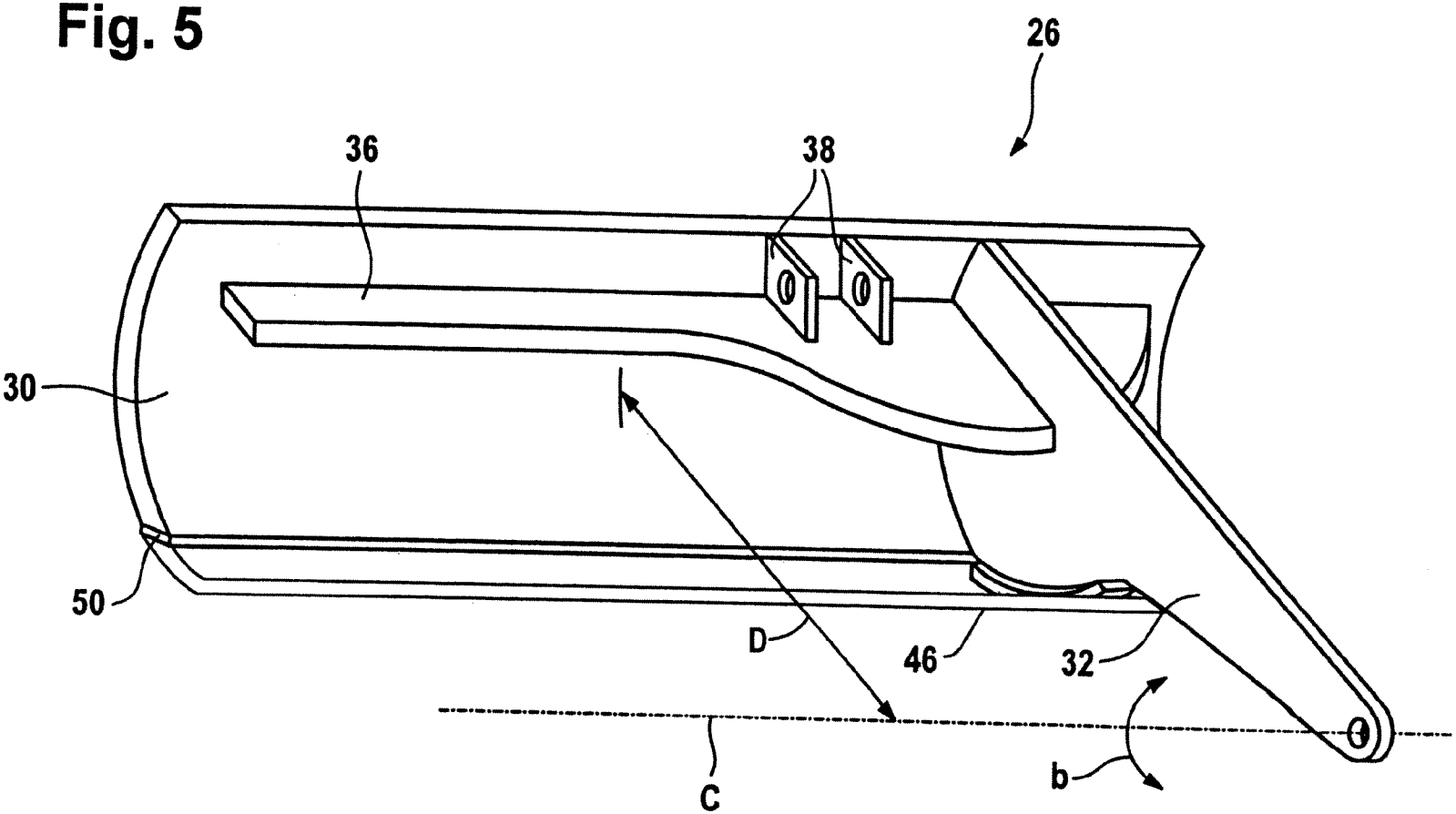
FIG. 5 is a perspective view of the sealing device from FIGS. 1 to 4 showing an alternative undercarriage skid.

In order to ensure good sliding of the sealing device 26 on the road surface 18, the sealing device 26 has an undercarriage skid 46 facing the road surface 18, extending from the side of the baffle plate 30 facing away from the opening B in the direction of travel a. The undercarriage skid 46, which is preferably made of hardened material and is replaceable, is bowed downward so that rolling of the undercarriage skid 46 on the road surface 18 during swiveling of the sealing device 26 and thus uniform wear are ensured. In the embodiment shown, the undercarriage skid 46 extends along the bottom side of the swivel arm 32, so that no additional support of the undercarriage skid 46 is required. The undercarriage skid 46 may extend over the entire width of the sealing device if desired (FIG. 5).

After the sealing device 26 is swiveled against the road surface 18, it forms a contact line 48 with the road surface 18. In order to keep the wear of the sealing device 26 low in the region of the contact line 48 on the sealing device 26, a sliding strip 50 is provided along the contact line 48. In the embodiment shown, the sliding strip 50, which is preferably made of hardened material and is arranged so that it is replaceable, extends along the lower edge of the baffle plate 30 facing the road surface 18.

The mode of operation of the rear loader road milling machine 2 is described below with reference to FIGS. 2 and 3.

In order to remove the road surface 18 by the road milling machine 2, first the wheels 6, 6 are lifted in order to bring the milling roll 20, which has the cutters (not shown), in contact with the road surface 18. Hereby, the milling roll 20 rotates in a direction of rotation c, which is opposite to the direction of rotation of the wheels 6, 6, 8. As soon as the milling roll 20 comes into contact with the road surface 18, milled material is removed, which is thrown backwards in the roller housing 16 above the milling roll 20, as indicated with an arrow d. From there, the milled material arrives into the transport device 24, which then introduces the milled material into an accompanying vehicle, which is not shown in detail.

In order to prevent the milled material from being thrown forward through the opening B, the sealing device 26 is swiveled against the road surface 18 with the aid of the hydraulic device, which is indicated with the aid of the piston/cylinder arrangement 40, using a predetermined pressure. In this position, the sealing device 26 forms, on the one hand, a contact line 42 with the front part 28 of the roller housing 16 and, on the other hand, a contact line 48 with the road surface 18, as a result of which, the opening B between the front part 28 of the roller housing 16 and the road surface 18 is closed completely by the baffle plate 30 of the sealing device 26. Thus, there is always a safe seal provided at small milling depths (FIG. 2) as well as at larger milling depths (FIG. 3).

If the predetermined pressure between the sealing device 26 and the road surface 18 is exceeded, which can, for example, be attributed to unevennesses in the road surface or an increase of the milling depth (FIG. 2 to FIG. 3), the hydraulic device is designed in such a way that this permits swiveling backward of the sealing device 26 around the axis C.

Due to the swivelability around the axis C, which is arranged in the direction of travel a in front of the milling roll 20, the sealing device 26 can follow all unevennesses within the road surface 18 and can adjust to all changes of milling depth, whereby protection against milled material thrown forward is not reduced nor is the constant advance of the milling roll hindered.

Advantageously, the sealing device 26 can be locked in different swiveled positions. Thus, for example, it is advantageous when the sealing device 26 can be locked in a lifted-up position in which it does not lie on the road surface 18, so that the road milling machine 2 can be transported with a transport vehicle to the place where it will be used. Any devices known in the state of the art can be used for locking the sealing device 26.

The invention claimed is:

1. Rear loader road milling machine comprising a milling roll and a transport device for transporting milled material to a truck through a rear of the road milling machine, the milling roll being arranged in a roller housing opened on a bottom side thereof, the housing having an opening facing a direction of travel between a front part of the roller housing and a road surface, the opening being closed with an adjustable sealing device, wherein the sealing device comprises a forward baffle plate facing the opening in front of the milling roll and at least one undercarriage skid facing the road surface, said undercarriage skid being arranged in front of the milling roll in the direction of travel, and said baffle plate comprising at least one swivel arm which is secured to said baffle plate and extends to an axis around which said baffle plate swivels, said axis being arranged in front of the baffle plate in the direction of travel so that the sealing device is pulled over the road surface and the undercarriage skid slides over the road surface.

2. Road milling machine according to claim 1, wherein the baffle plate comprises a circular-arc-shaped cross-section.

3. Road milling machine according to claim 2, wherein the radius of the circular-arc-shaped cross-section corresponds to a distance between the axis and the baffle plate.

4. Road milling machine according to claim 1, wherein the sealing device swivels around the axis with the permanent formation of a contact line with the front part of the roller housing.

5. Road milling machine according to claim 4, wherein a longitudinally extending sealing or stripping element is provided on the roller housing along the contact line.

6. Road milling machine according to claim 1, wherein the undercaniage skid extends in the direction of travel.

7. Road milling machine according to claim 6, wherein the undercarriage skid extends over the entire width of the sealing device.

8. Road milling machine according to one of claim 1, wherein the undercarriage skid is bowed downwardly.

9. Road milling machine according to claim 1, wherein the undercaniage skid is replaceable.

10. Road milling machine according to claim 9, wherein the undercarriage skid is made of hardened material which has a greater hardness than the material of the other components of the sealing device.

11. Road milling machine according to claim 1, wherein the sealing device swivels against the road surface with the development of a contact line with the road surface.

12. Road milling machine according to claim 11, comprising a sliding strip provided on the sealing device along the contact line.

13. Road milling machine according to claim 12, wherein the sliding strip is replaceable.

14. Road milling machine according to claim 1, wherein the undercaniage skid is made of hardened material which has a greater hardness than the material of the other components of the sealing device.

15. Road milling machine according to claim 1, wherein the sealing device swivels against road surface with a predetermined pressure.

16. Road milling machine according to claim 15, wherein the sealing device swivels backward when a predetermined pressure is exceeded.

17. Road milling machine according to claim 1, wherein the sealing device swivels around the axis with the aid of a hydraulic device.

18. Road milling machine according to claim 17, wherein a hydraulic pressure is adjustable, whereby the hydraulic device allows the sealing device to swivel backward when a predetermined hydraulic pressure is exceeded.

19. Road milling machine according to claim 1, wherein the sealing device is lockable in different positions.

* * * * *